US008336535B2

(12) United States Patent
Larsen et al.

(10) Patent No.: US 8,336,535 B2
(45) Date of Patent: Dec. 25, 2012

(54) FRENCH DOOR COOKING APPLIANCE CLOSURE SYSTEM

(75) Inventors: Christopher A. Larsen, Cleveland, TN (US); David E. Levi, Ringgold, GA (US); Mark A. Pickering, Cleveland, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1715 days.

(21) Appl. No.: 11/485,474

(22) Filed: Jul. 13, 2006

(65) Prior Publication Data

US 2007/0246036 A1 Oct. 25, 2007

Related U.S. Application Data

(60) Provisional application No. 60/793,251, filed on Apr. 20, 2006.

(51) Int. Cl.
*F23M 7/00* (2006.01)

(52) U.S. Cl. ..... 126/190; 126/192; 49/475.1; 49/483.1; 49/484.1; 110/173 R

(58) Field of Classification Search ..... 126/190, 126/198, 191, 197, 192, 194, 200; 312/405, 312/109, 138.1, 326; 110/173 R, 176; 49/103, 49/367, 368, 475.1, 483.1, 484.1
See application file for complete search history.

(56) References Cited

U.S. PATENT DOCUMENTS 1,101,094 A * 6/1914 Reiber ..... 110/173 C
1,867,589 A * 7/1932 Phillips et al. ..... 292/275
2,025,480 A * 12/1935 Sponsler ..... 49/103
2,206,051 A * 7/1940 Roof ..... 49/103
2,465,555 A * 3/1949 Smith ..... 312/275
2,692,809 A * 10/1954 Kesling ..... 312/405
2,707,225 A 4/1955 Pearce
2,708,709 A * 5/1955 Pearce ..... 219/414
2,723,896 A * 11/1955 Wurtz ..... 312/296
2,807,837 A * 10/1957 Kesling ..... 49/492.1
2,823,664 A 2/1958 Evans et al.
2,836,268 A 5/1958 Evans
2,889,825 A * 6/1959 Evans ..... 126/198
3,009,458 A 11/1961 Pearce
3,036,193 A * 5/1962 Allen, Jr. ..... 219/391
3,045,663 A 7/1962 McDonnold
3,070,852 A * 1/1963 Hilliker ..... 49/366
3,091,232 A * 5/1963 Allen, Jr. et al. ..... 126/190
3,409,003 A 11/1968 Rehberg et al.
3,409,004 A 11/1968 Rehberg
3,707,145 A 12/1972 Anetsberger et al.
4,288,135 A * 9/1981 Buchser et al. ..... 312/296
(Continued)

*Primary Examiner* — Kenneth Rinehart
*Assistant Examiner* — Jorge Pereiro
(74) *Attorney, Agent, or Firm* — Jason S. Burnette; Diederiks & Whitelaw PLC

(57) ABSTRACT

A cooking appliance includes an oven cavity accessed through first and second French-style doors that are connected to the appliance through a door linkage system. The door linkage system establishes a particular timing of door openings and closings to minimize potential wear of a door gasket. That is, each of the doors has an associated gasket for use in sealing the oven cavity when the doors are closed. One of the doors is provided with an annular gasket, while the other door essentially incorporates a less that fully annular, preferably 3-sided or a three-quarter gasket. With this arrangement, each of the gaskets has three sides adapted to seal against a cabinet shell portion of the appliance, while the fourth side of the first gasket is adapted to seal against an extension provided on the other door.

20 Claims, 15 Drawing Sheets

U.S. PATENT DOCUMENTS 4,428,153 A * 1/1984 Klinger et al. ..... 49/366
4,508,098 A * 4/1985 Scheler ..... 126/545
4,515,146 A * 5/1985 Wilkening ..... 126/545
4,603,683 A * 8/1986 Craver ..... 126/531
4,711,098 A * 12/1987 Kuwabara et al. ..... 62/441
4,949,505 A * 8/1990 Cohrs ..... 49/367
5,061,022 A * 10/1991 Meriwether ..... 312/324
5,411,328 A * 5/1995 You ..... 312/405
5,465,528 A * 11/1995 Schinzel et al. ..... 49/368
5,471,972 A 12/1995 Corliss, II et al.
5,584,284 A 12/1996 Corliss, II et al.
5,651,216 A * 7/1997 Tillmann ..... 49/367
5,816,080 A * 10/1998 Jeziorowski ..... 62/441
5,880,436 A * 3/1999 Keogh ..... 219/400
5,975,661 A * 11/1999 Jeziorowski et al. ..... 312/296
5,975,664 A * 11/1999 Banicevic et al. ..... 312/405
5,988,154 A 11/1999 Douglas et al.
6,401,393 B2 * 6/2002 Juntunen ..... 49/367
6,449,904 B1 * 9/2002 Paasonen ..... 49/103
6,564,510 B2 * 5/2003 Juntunen et al. ..... 49/103
6,742,302 B2 * 6/2004 Karkkainen ..... 49/103
7,008,032 B2 * 3/2006 Chekal et al. ..... 312/405
2006/0232176 A1 * 10/2006 Kim et al. ..... 312/405
2007/0039605 A1 * 2/2007 Larsen ..... 126/191
2007/0039606 A1 * 2/2007 Larsen et al. ..... 126/197
2007/0216271 A1 * 9/2007 Tarantik ..... 312/405

* cited by examiner

FRENCH DOOR COOKING APPLIANCE CLOSURE SYSTEM

CROSS-REFERENCE TO RELATED APPLICATION

The present application claims the benefit of U.S. Provisional Patent Application Ser. No. 60/793,251 filed Apr. 20, 2006 entitled "French Door Cooking Appliance Closure System."

BACKGROUND OF THE INVENTION

1. Field of the Invention

The present invention pertains to the art of cooking appliances and, more particularly, to a door linkage system for an oven having French-style doors. Even more specifically, the invention is directed to a French-style door seal mounting and timing arrangement designed to minimize seal gasket wear.

2. Discussion of the Prior Art

It is widely known to provide a cooking appliance, such as an oven range or a wall oven, with a single, generally rectangularly shaped door that pivots about a horizontal axis. That is, a top portion of the oven door is pulled outward from the appliance about horizontally disposed hinges and lowered into a horizontal position to provide access to the oven cavity. While this type of oven door has found wide spread use, it is not entirely satisfactory for every application. For instance, an oven door that rotates about a horizontal axis projects outward from the appliance a considerable distance. This distance must be taken into consideration when deciding where to locate the appliance in the kitchen. Otherwise, the opened door could interfere with traffic patterns in the kitchen or with access to other cabinetry. In addition, such an oven door may require a consumer to stand at a side of the appliance to fully access the oven cavity. In order to address this problem, some manufacturers provide their ovens with one or more doors that swing open about substantially vertical axes.

Incorporating French-style doors into cooking appliances is also known in the art. An oven employing French-style doors will typically include a linkage that translates linearly so as to cause both of the doors to open or close when either one of the doors is operated. In this manner, the doors can be operated with only one hand, leaving the other hand free to hold a food item. While this type of door arrangement does address many of the shortcomings associated with horizontally swinging doors, French-style doors include several shortcomings of their own. For example, proper door sealing to avoid excessive heat loss from the oven cavity is an important concern. In at least arrangements employing doors which interengage when closed, in order for the doors to close and seal properly, one of the doors must lag relative to the other. In this manner, a proper seal can be maintained about the oven cavity without requiring a consumer to close each of the doors separately. Moreover, the linkage must properly retain the doors in the closed position in order to ensure that hot oven gases do not escape. Other areas of concern include providing end stops or detents so that the doors do not inadvertently swing shut.

The timing of the doors is actually crucial to the sealing properties of the cooking appliance. In particular, if the timing is off, undue seal wear can occur, resulting in undesirable heat losses from the oven cavity during use of the appliance. Known in the art is the use of stainless door wipers. These wipers are resilient, but do not follow contours easily and are prone to have gaps at their ends. Typically, a continuous glass fiber based seal is employed to close these corner gaps in order to maintain a tighter seal between the oven cavity and the door, while also being easier to install. Certain other types of known seals, such as silicone gaskets, will not stand up to self clean temperatures. Attempts have actually been made to provide silicone gaskets on the inside edges of both doors with a door timing wherein both doors are matched in their opening positions. Generally the consumer will open the doors using one handle. This biases the door timing mechanism, causing one door to move first and the gaskets to slide against each other. Simply stated, a fiber based seal will not withstand this wear. Improved quality in the mechanism could reduce the wear but is considered to be too expensive.

Therefore, despite the existence of French-style doors employed in cooking appliances of the prior art, there still exists a need for a French-style oven door mounting and timing system which provides for minimal wear on the gasket or sealing arrangement.

SUMMARY OF THE INVENTION

The present invention is directed to a closure system for a cooking appliance including an oven cavity closed by a pair of laterally spaced, French-style doors. In accordance with the invention, the cooking appliance includes a cabinet shell and an oven cavity arranged within the cabinet shell, with the oven cavity having top, bottom, rear and opposing side walls that collectively define a frontal opening. The cooking appliance is provided with first and second doors that are pivotally mounted relative to the cabinet shell for selectively closing the frontal opening of the oven cavity. More specifically, the first and second doors constitute French-style doors that open about substantially vertical axes.

The first and second doors are interconnected through the door linkage system. More specifically, the door linkage system interconnects each of the first and second doors to one another, as well as with the cabinet shell. The door linkage system includes a first door control arm having a first end, which is pivotally mounted to the first door, and a second end. The door linkage system also includes a second door control arm having a first end, which is pivotally mounted to the second door, extending to a second end that is pivotally connected to the second end of the first door control arm.

The second ends of the first and second door control arms are mounted in such a manner so as to travel in arcuate paths when either one of the first and second doors is operated. More specifically, when one of the first and second doors is moved in either an opening or a closing direction, the second ends of the first and second door control arms travel over the arcuate paths, causing the other of the first and second doors to move in a corresponding direction.

At least one of the door control arms has associated therewith a camming surface upon which rides a corresponding cam follower as the doors transition between open and closed positions. The overall cam follower arrangement provides a sealing force to the first and second doors in the closed position. Additionally, the camming surface is provided with a plurality of detents that establish various, selectable positions for the doors. That is, the detents engage with the cam followers in order to selectively retain the first and second doors at any one of various locations ranging from a fully open position to a fully closed position, with at least one detent residing at the fully open position to ensure that the first and second doors do not inadvertently swing closed.

The first and second control arms are operatively connected to a support bracket through a linkage control arm. The linkage control arm establishes the arcuate path tracked by first and second ends of the door control arms, as well as a particular timing of the doors. With this arrangement, as the doors transition between the open and closed positions, the linkage control arm engages the cam follower. The cam follower travels along the camming surface to provide for a smooth transition.

Each of the doors has an associated gasket for use in sealing the oven cavity when the doors are closed. In accordance with the invention, one of the doors is provided with an annular gasket, while the other door essentially incorporates a less that fully annular, preferably 3-sided, gasket. Most preferably, a three-quarter gasket is employed. With this arrangement, each of the gaskets has three sides adapted to seal against the cabinet shell, while the fourth side of the first gasket is adapted to seal against an extension provided on the other door. An important aspect of the invention is to minimize abrasion on the first gasket by designing both the gasket contact point or line, and the door timing so as to produce a contact arrangement similar to that exhibited with standard single door units.

In connection with the invention, the gasket configurations and constructions, along with the construction and operation of the door linkage system, combine to provide a synergistic effect in minimizing potential wearing of the seal arrangement. To this end, the timing of the opening and closing of the doors is important. The door linkage system overcomes an issue of slop in the mechanism by intentionally moving one door farther than the other when the doors are first opened. Instead of the doors opening evenly, one door initially moves significantly farther than the other, breaking the contact between the first gasket and a mating portion of the other door. In the most preferred form of the invention, the oven cavity/cabinet shell, as well as the door extension, is provided with a porcelain coating. With this construction, each of the gaskets is only seated against porcelain coated surfaces to minimize wear caused by surface roughness.

In accordance with the invention, the annular gasket does not make contact with the side of the other door panel. If placed in this position, the gasket would be compressed as the doors are opened, loose its ability to return to shape after being subjected to the high temperatures of several self cleaning operations, and not return to a shape needed for properly sealing the doors. Instead, the fourth side, or center seal, of the gasket on the first door contacts the extension of the opposite door. This extension places the contact surface mostly behind the gasket. As the doors are opened, the timing established by the linkage system pulls the gasket away from the sealing surface behind it. By breaking the contact early in the door opening process, the seal is saved from any unnecessary crushing or abrasion.

An additional feature of the invention is that different rates of movement are imparted to the doors when nearing closed positions in order to help assure good contact of the center seal. The timing established by the linkage system will continue to pull the doors closed until the center seal or gasket makes contact, thereby providing a mechanically advantaged force to balance a force applied by a door closure spring. In any case, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
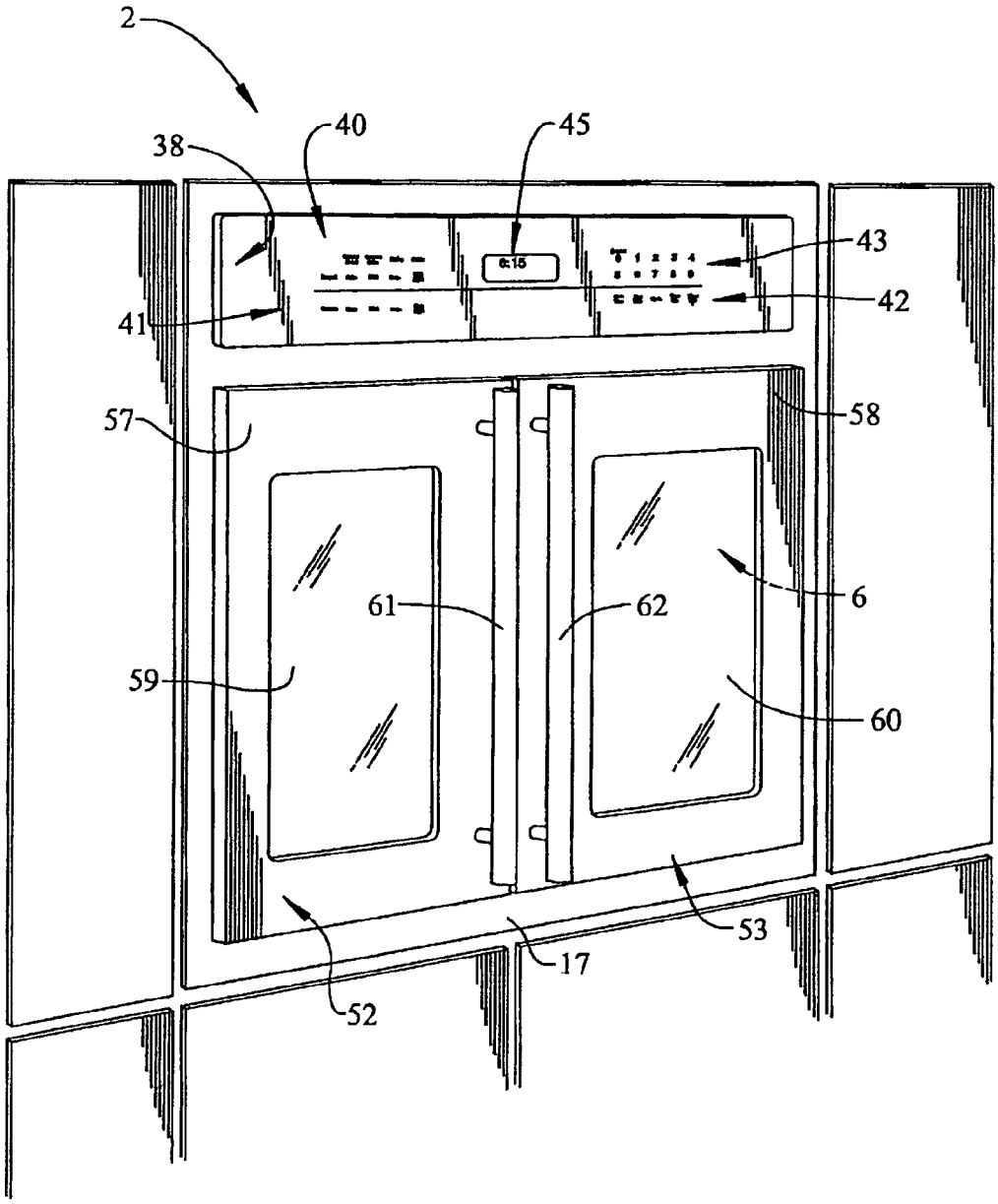
FIG. 1 is a perspective view of a cooking appliance including French-style doors constructed in accordance with the invention, with the doors being shown in a fully closed position.
Figure 2:
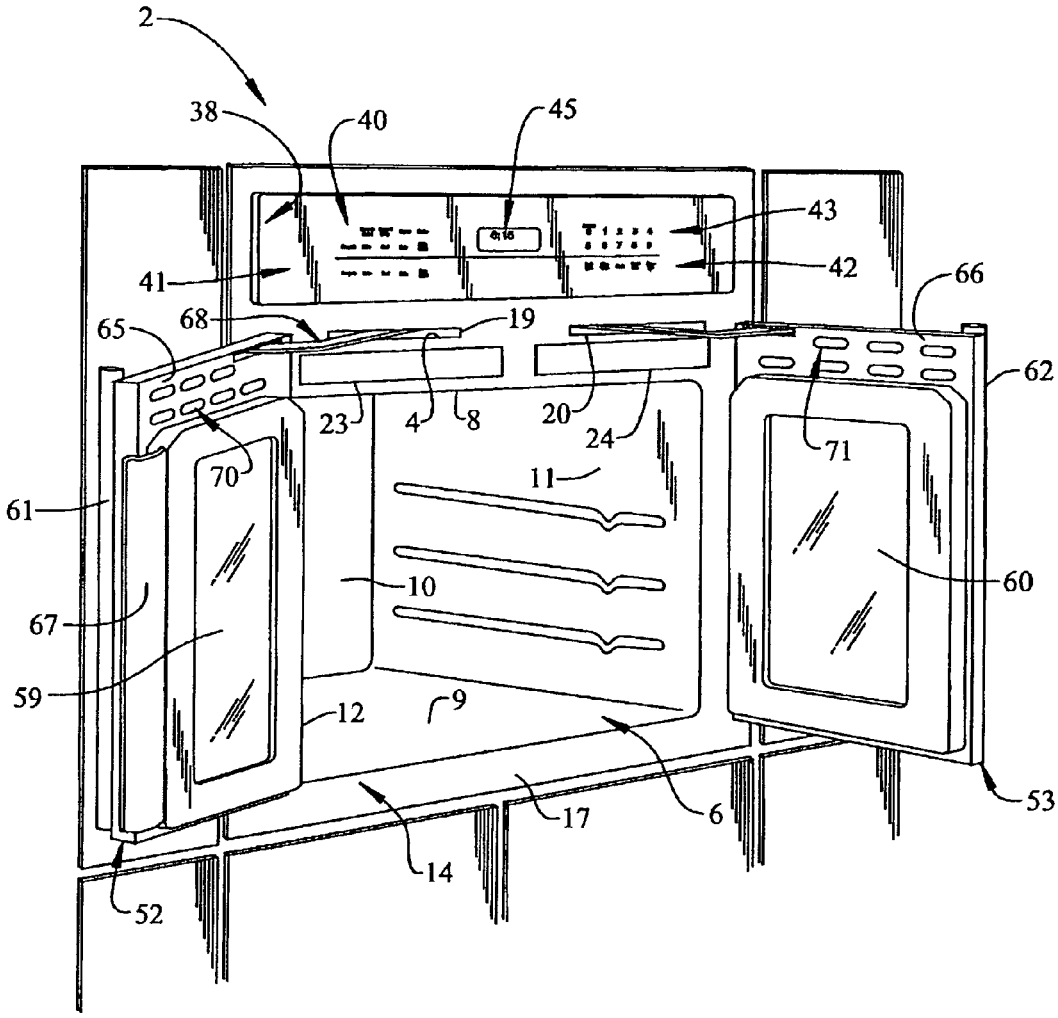
FIG. 2 is a perspective view of the cooking appliance of FIG. 1 showing the French-style doors in a fully open position.

With initial reference to FIGS. 1 and 2, a cooking appliance constructed in accordance with the present invention is generally indicated at 2. As depicted, cooking appliance 2 constitutes a wall oven. However, it should be understood that the present invention is not limited to this particular model type and can be incorporated into various types of oven configurations, e.g., cabinet mounted ovens, as well as both slide-in and free-standing ranges. In any event, in the embodiment shown, cooking appliance 2 constitutes a single wall oven unit including a frame 4 (best seen in FIG. 3) that supports, at least in part, an oven cavity 6. Oven cavity 6 includes a top wall 8, a bottom wall 9, a rear wall 10 and opposing side walls 11 and 12 that collectively define a frontal opening 14. In a manner known in the art, frontal opening 14 is surrounded by a face frame portion 17 which provides an overall aesthetic finish to cooking appliance 2. Preferably, face frame portion 17 is provided with first and second openings 19 and 20 which, as will be discussed more fully below, lead to frame 4. Face frame portion 17 is also provided with additional openings 23 and 24 that form part of an overall airflow system of cooking appliance 2.

In a manner known in the art, cooking appliance 2 includes a control panel 38 having a plurality of control elements. In accordance with the embodiment shown, the control elements are constituted by first, second and third sets of oven control buttons 40-42, as well as a numeric pad 43. Control panel 38 is adapted to be used to input desired cooking parameters and establish operating conditions for cooking appliance 2. More specifically, first, second and third sets of control buttons 40-42, in combination with numeric pad 43 and a display 45, enable a user to establish particular cooking operations that are performed within oven cavity 6. As the oven control is known in the art and does not form part of the present invention, it will not be discussed further herein.

In accordance with the invention, cooking appliance 2 is provided with French-style doors that are adapted to selectively seal across frontal opening 14. More specifically, cooking appliance 2 includes a first door 52 and a second door 53 that are pivotally mounted relative to frame 4 and adapted to be moved from a fully closed position, as represented in FIG. 1, to a fully open position, as represented in FIG. 2, to provide access to oven cavity 6. As will be clear from the remaining figures, doors 52 and 53 swing outward about substantially vertical axes established by upper hinges 54 and 55 (FIG. 4) and lower hinges (not shown).

In a manner known in the art, each door 52, 53 is provided with a corresponding outer panel 57, 58 having a respective central transparent zone or window 59, 60. In addition, each door 52, 53 is provided with a corresponding handle 61, 62 that enables a consumer to shift doors 52 and 53 between open and closed positions. In order to provide a proper seal about frontal opening 14, each door 52, 53 includes an inner panel 65, 66 about which extends a peripheral seal or gasket as discussed in detail below. In addition, first door 52 is provided with a flange 67 that serves as an intermediate sealing surface for second door 53. That is, when both first and second doors 52 and 53 are moved to the closed position of FIG. 1, flange 67 traverses an intermediate gap or opening (not separately labeled) laterally between doors 52 and 53. Although not part of the present invention, doors 52 and 53 are shown to include a plurality of openings indicated generally at 70 and 71 on inner panels 65 and 66. Openings 70 and 71 allow a flow of air to pass from within doors 52 and 53 into openings 23 and 24 and around oven cavity 6. The airflow minimizes the conduction of heat from oven cavity 6 to outer panels 57 and 58 of doors 52 and 53. In any event, in order to provide a consumer easy access to oven cavity 6, cooking appliance 2 is provided with a door linkage system 68 (FIG. 2) that interconnects first and second doors 52 and 53. Linkage system 68 operates such that movement of either one of first and second door 52 and 53 causes the other one of first and second doors 52 and 53 to move or shift in a corresponding manner as will be detailed more fully below.

Figure 3:
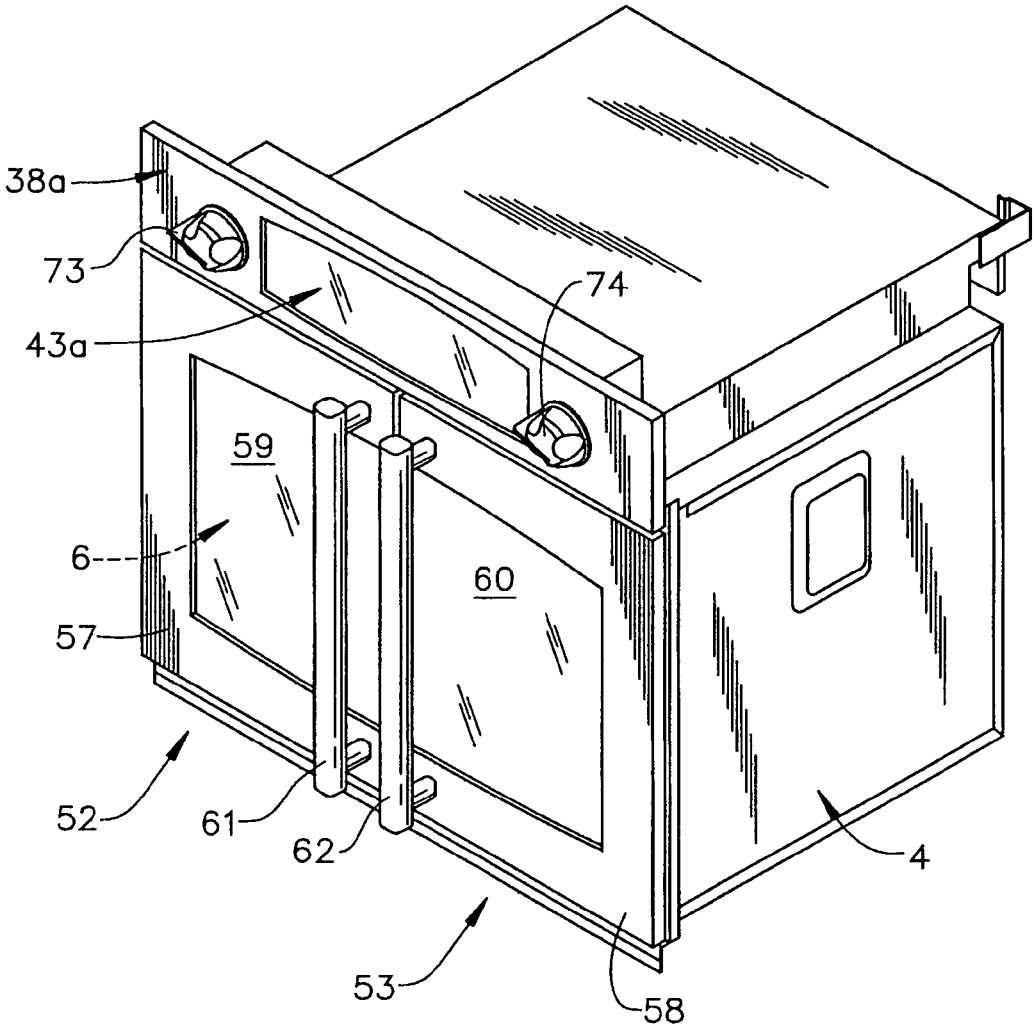
FIG. 3 is a perspective view of another cooking appliance including French-style doors constructed in accordance with the invention, with the doors being shown in a fully closed position.

FIG. 3 is presented to simply illustrate that the overall design of the cooking appliance can vary in accordance with the invention. In particular, this figure indicates control panel 38*a* having control knobs 73 and 74 which, along with an enlarged display 43*a*, are used in programming the appliance for a cooking operation. In any case, various configurations can be employed without departing from the invention as will become fully evident from the following invention description.

Figure 4:
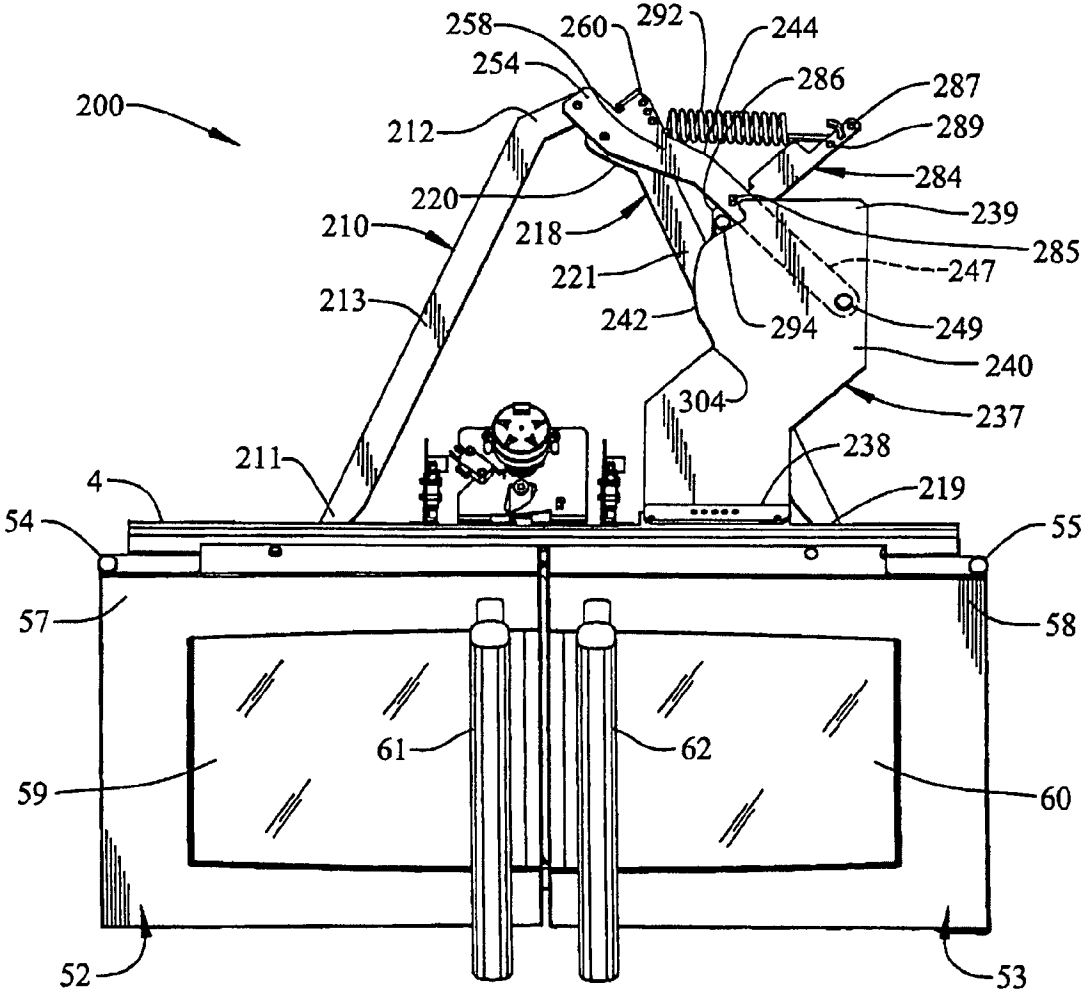
FIG. 4 is an upper perspective view of a door linkage system constructed in accordance with one embodiment of the present invention with the doors in a closed position.
Figure 5:
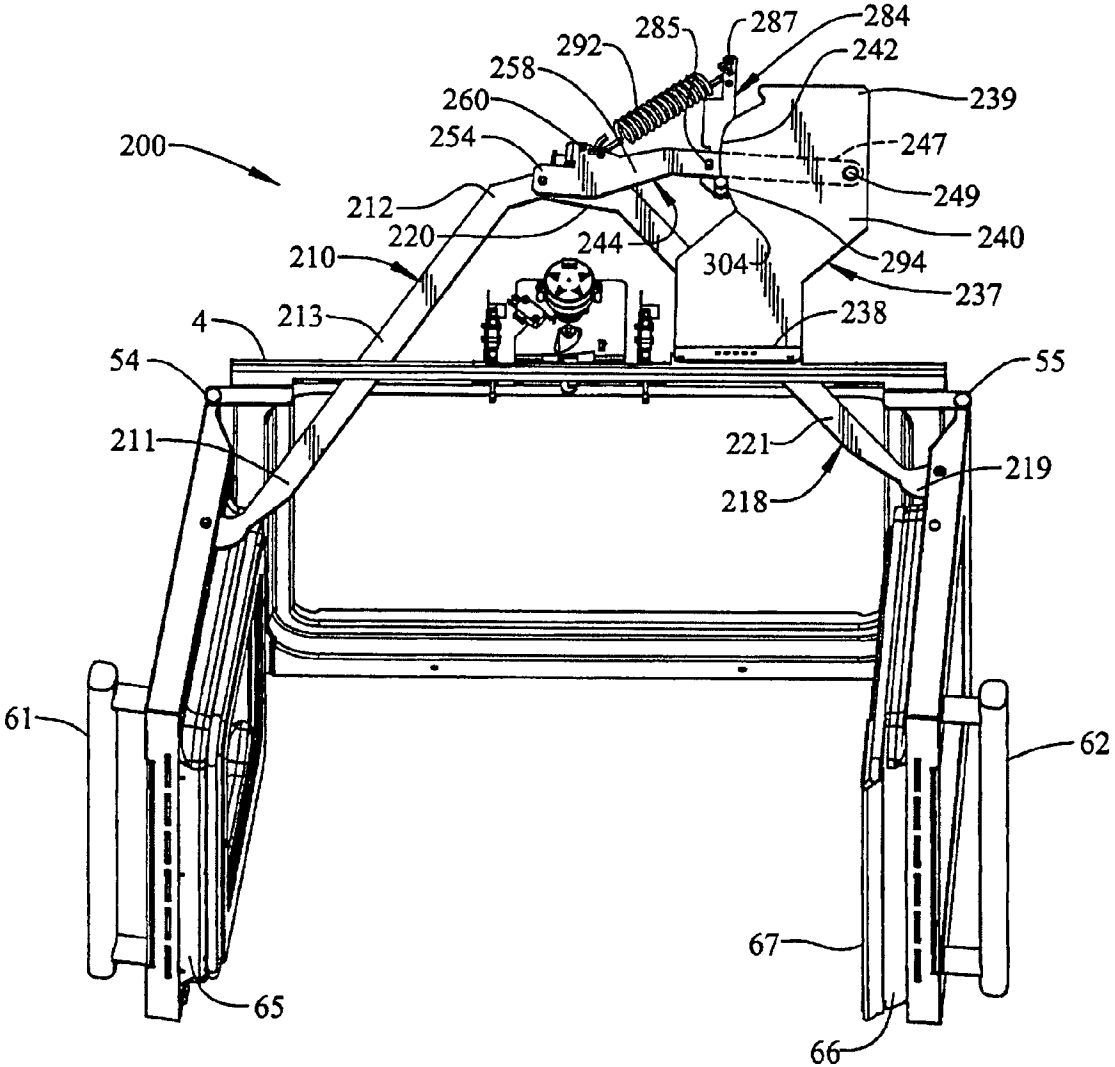
FIG. 5 is an upper perspective view of the door linkage system of FIG. 4 with the doors moving towards an open position.
Figure 6:
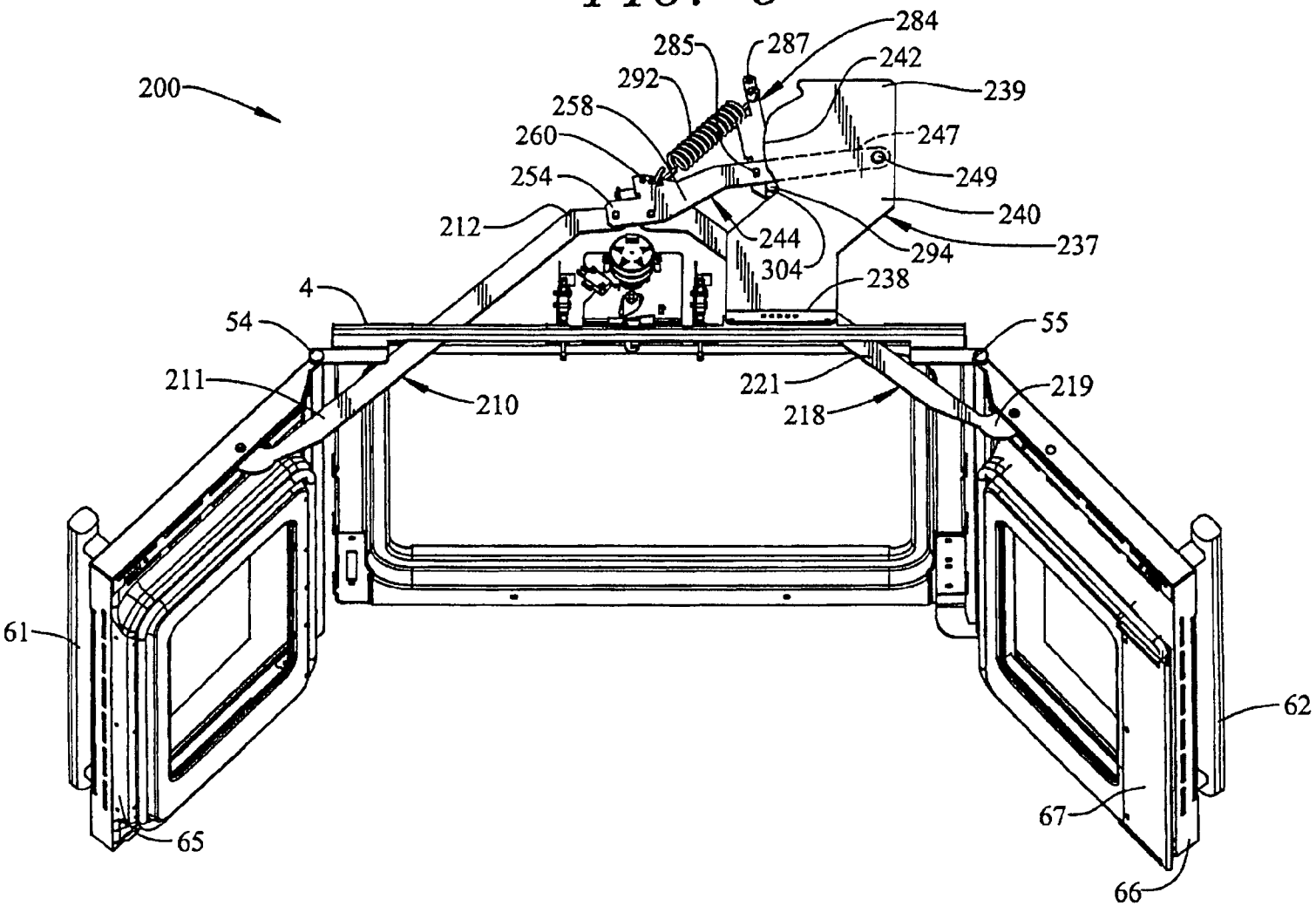
FIG. 6 is an upper perspective view of a door linkage system of FIG. 5 with the doors in a fully open position.

Reference will now be made to FIGS. 4-6 in describing a linkage system 200 constructed in accordance with an embodiment of the invention. Linkage system 200 includes a first control arm 210 having a first end 211 which is pivotally connected to door 52 and extends to a second end 212 through an intermediate portion 213. In addition, linkage system 200 includes a second control arm 218 having a first end 219 which is pivotally connected to door 53 and extends to a second end 220 through an intermediate portion 221. In a manner discussed more fully below, first and second control arms 210 and 218 interconnect first and second doors 52 and 53 such that operation of one door, for example door 52, will result in a similar movement to second door 53.

In accordance with the invention, linkage system 200 includes a stationary control arm or support member 237 having a first end 238 fixedly mounted relative to frame 4 and extending to a second end 239 through an intermediate portion 240. In a manner which will be discussed more fully below, a section of intermediate portion 240 includes a camming surface 242. First and second control arms 210 and 218 are operatively connected to support member 237 through a linkage control arm 244. More specifically, linkage control arm 244 includes a first end 247 pivotally connected to intermediate portion 240 of support member 237 at a pivot point or axis 249. First end 247 extends to a second end 254 through an intermediate portion 258. For reasons which will be described more fully below, second end 254 is provided with a plurality of openings, indicated generally at 260.

In accordance with this form of the invention, linkage system 200 includes a tensioning bracket 284 connected to linkage control arm 244 through a pivot pin 285. Tensioning bracket 284 includes a first end 286 that extends to a second end 287. Second end 287 is provided with a plurality of apertures, indicated generally at 289. With this arrangement, a spring 292 is fastened at one of the plurality of apertures 289 and one of the plurality of openings 260 on linkage control arm 244 to provide tension to first and second control arms 210 and 218. More specifically, by selecting between the plurality of apertures 289 and/or plurality of openings 260, a desired tension can be placed on linkage control arm 244. In any event, tensioning bracket 284 is shown to include a cam follower 294 provided at first end 286. As will be described more fully below, cam follower 294 cooperates with camming surface 242 and linkage control arm 244 to guide doors 52 and 53 between a closed position, as represented in FIG. 4, through an intermediate position, as represented in FIG. 5, to a fully open position as represented in FIG. 6.

As best shown in FIG. 4, when doors 52 and 53 are in the closed position, linkage control arm 244 rests upon cam follower 294 with the tension in spring 292 being at a minimum level. As doors 52 and 53 transition towards the intermediate position, linkage control arm 244, through a force provided by first and/or second door control arms 210 and 218, transitions along an arcuate path causing cam follower 294 to travel along camming surface 242. In addition, spring 292 provides tension to first and second control arms 210 and 218 to ensure that doors 52 and 53 do not swing open freely. However, once cam follower 294 passes over a high portion (not separately labeled) of camming surface 242, tensioning bracket 284 aids in shifting doors 52 and 53 to the fully open position. Once doors 52 and 53 reach the fully open position as shown in FIG. 6, cam follower 294 rests at a bottom portion or notch section 304 of camming surface 242. By positioning cam follower 294 in notch section 304, doors 52 and 53 are maintained in a fully open position allowing a consumer to freely introduce a food item into oven cavity 6.

At this point, it is possible to shift doors 52 and 53 to the closed position as represented in FIG. 4. Accordingly, a consumer need operate either door 52 and/or 53 to close cooking appliance 2. That is, by operating either door 52 or 53, a respective control arm 210, 218 exerts a force on linkage control arm 244. Linkage control arm 244 is guided back to the home position, with cam follower 294 moving along camming surface 242. More specifically, tensioning bracket 284, in combination with cam follower 294, ensures that doors 52 and 53 transition smoothly towards the closed position. As cam follower 294 transitions over a top portion (not separately labeled) of camming surface 242, spring 292 pulling on linkage control member 244 aids in the overall closing and sealing of doors 52 and 53.

At this point, it should be understood that various linkage systems can be designed to carry out the required closure timing of the French-style doors for the cooking appliance of the invention. For instance, the linkage systems disclosed in pending U.S. patent application Ser. No. 11/206,219 entitled "Door Linkage System for an Oven Having French-Style Doors", the disclosure of which is hereby incorporated by reference, could be employed. Even if the linkage system is varied, it is important to provide flexibility for setting the particular timing of the closing of the doors in order to prevent undue wear on door seals.

Figure 7:
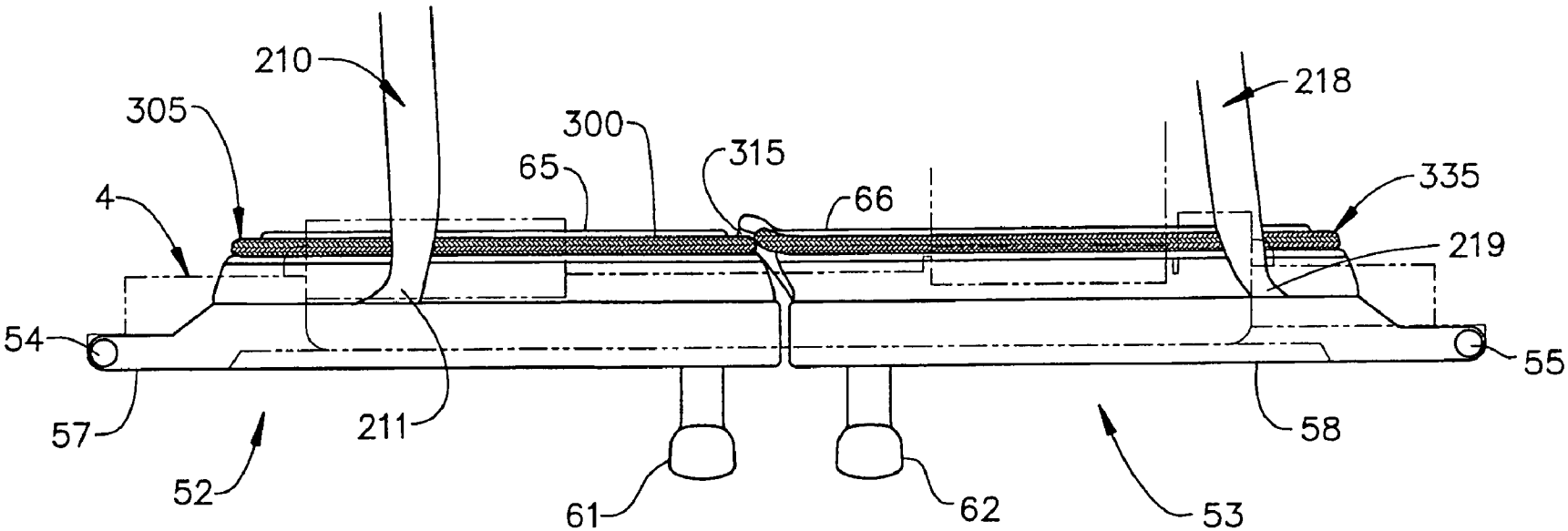
FIG. 7 is a top view of a door linkage system used to control the doors of the cooking appliance of FIG. 1 or 3 illustrated with the French-style doors in a fully closed position.
Figure 8:
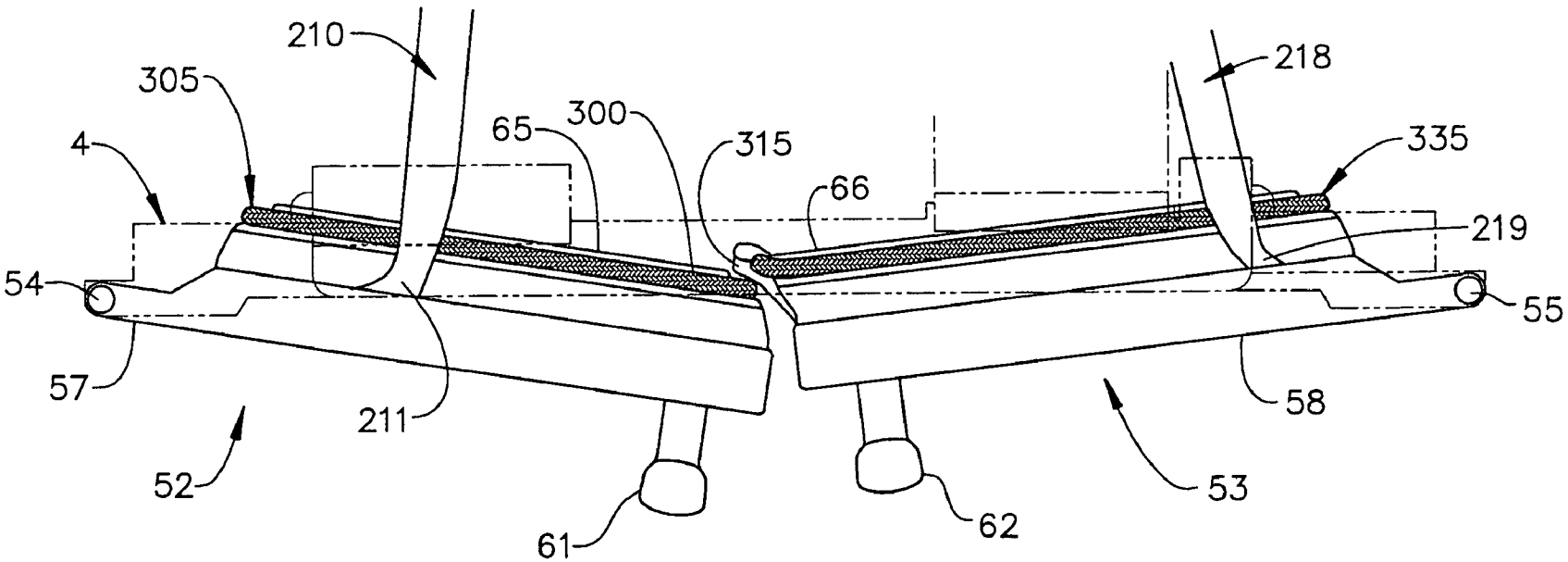
FIG. 8 is a top view of the door and linkage system similar to FIG. 5, but with the doors open a small amount.
Figure 9:
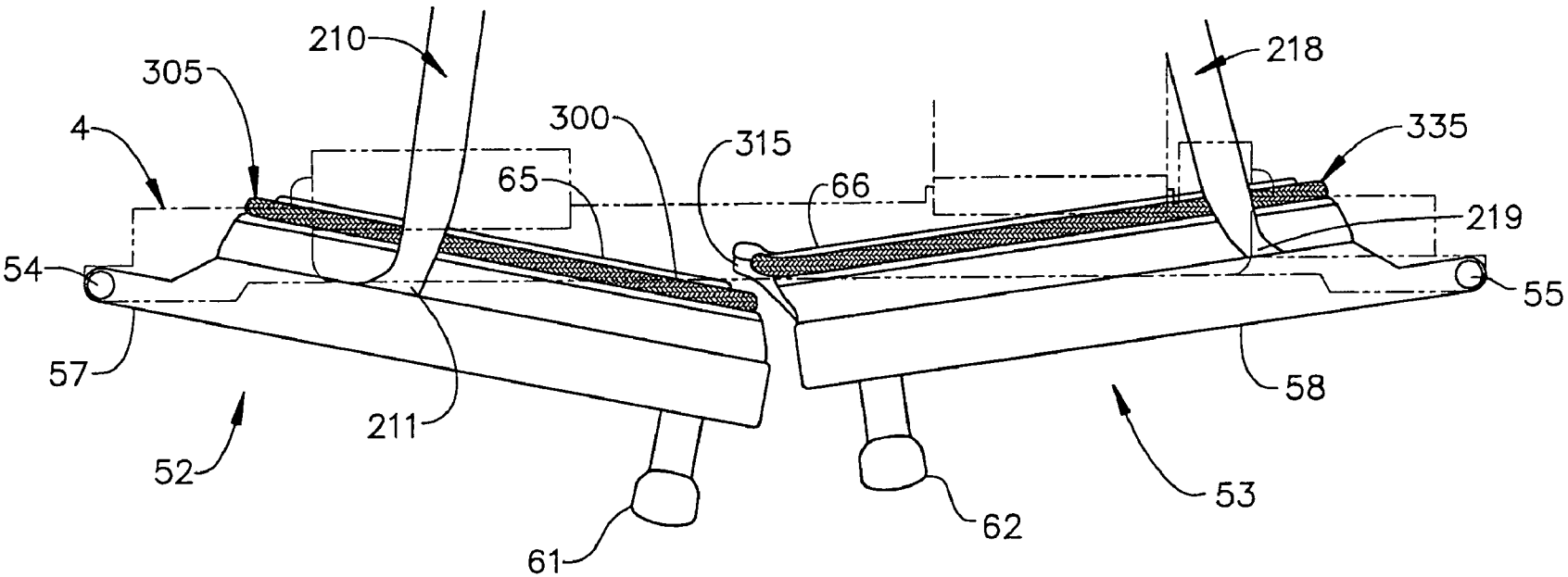
FIG. 9 is a top view similar to FIG. 8, but with the doors opened a slightly greater amount, such as about 3-5°.
Figure 10:
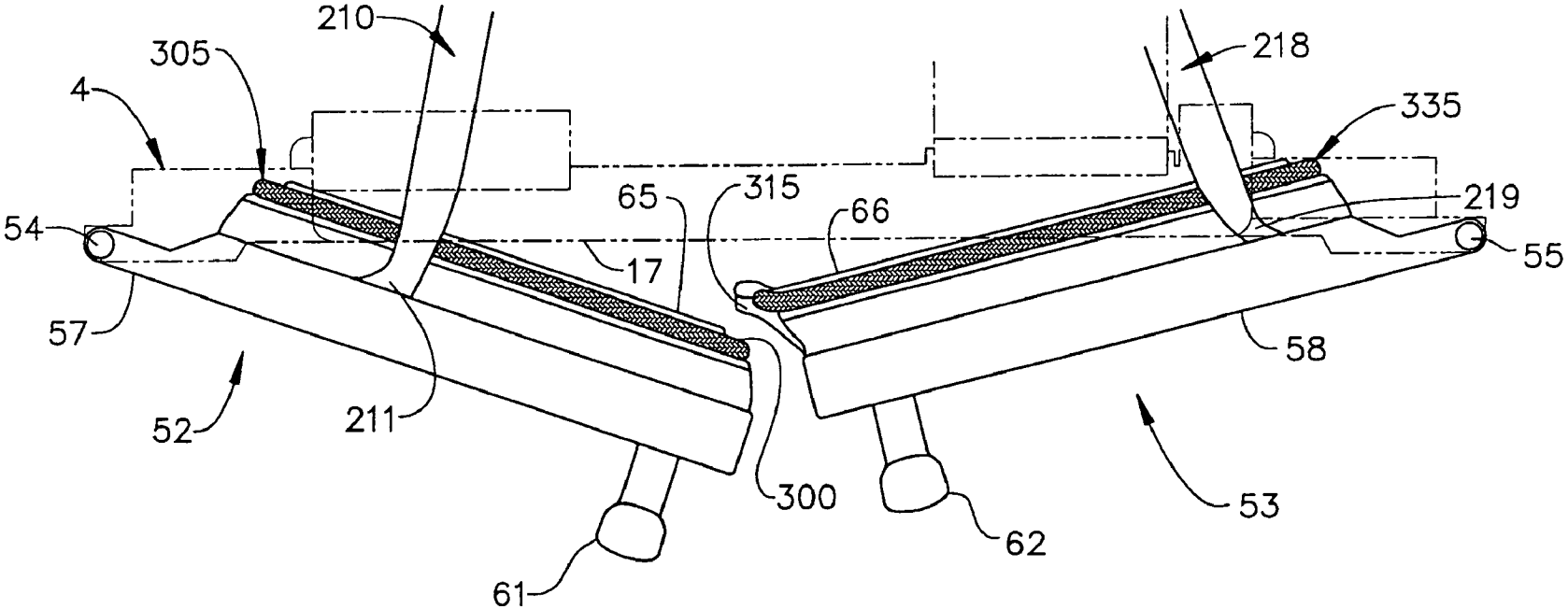
FIG. 10 is a top view of the door linkage system of FIG. 9 with the doors moved further towards the fully open position.
Figure 11:
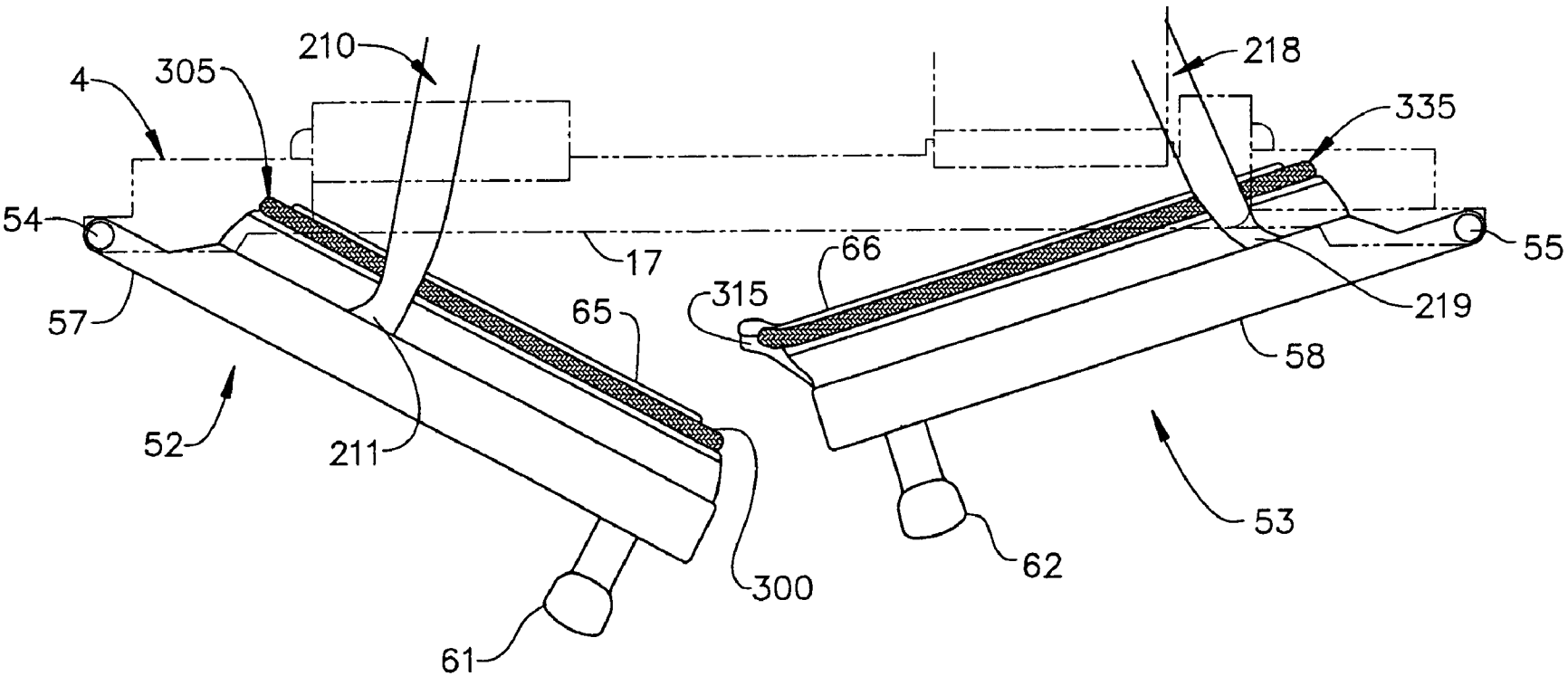
FIG. 11 is a top view of the door linkage system of FIG. 10 with the doors moved even further towards the fully open position.
Figure 12:
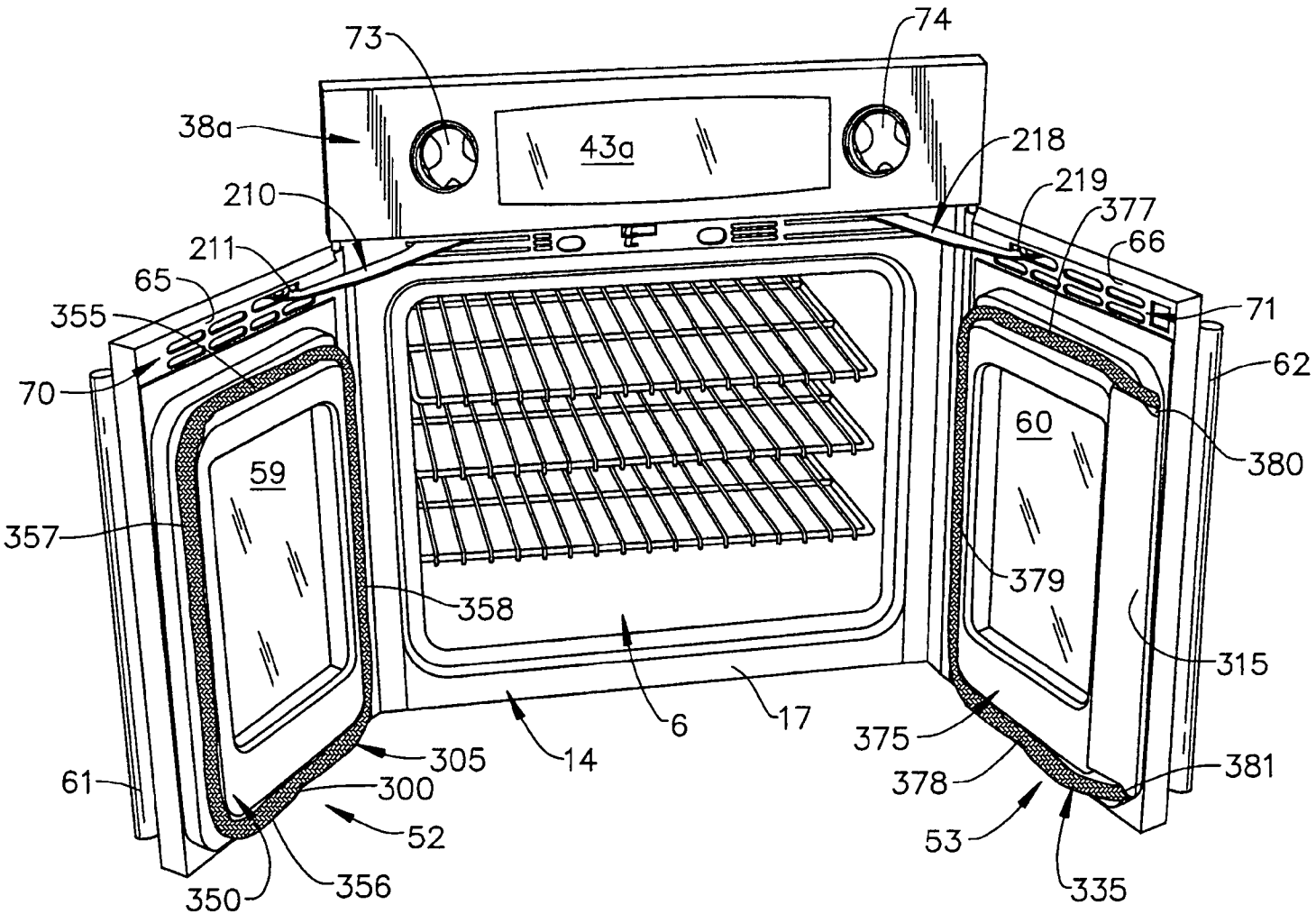
FIG. 12 shows an oven cavity of the cooking appliance exposed as the doors are fully opened.
Figure 13:
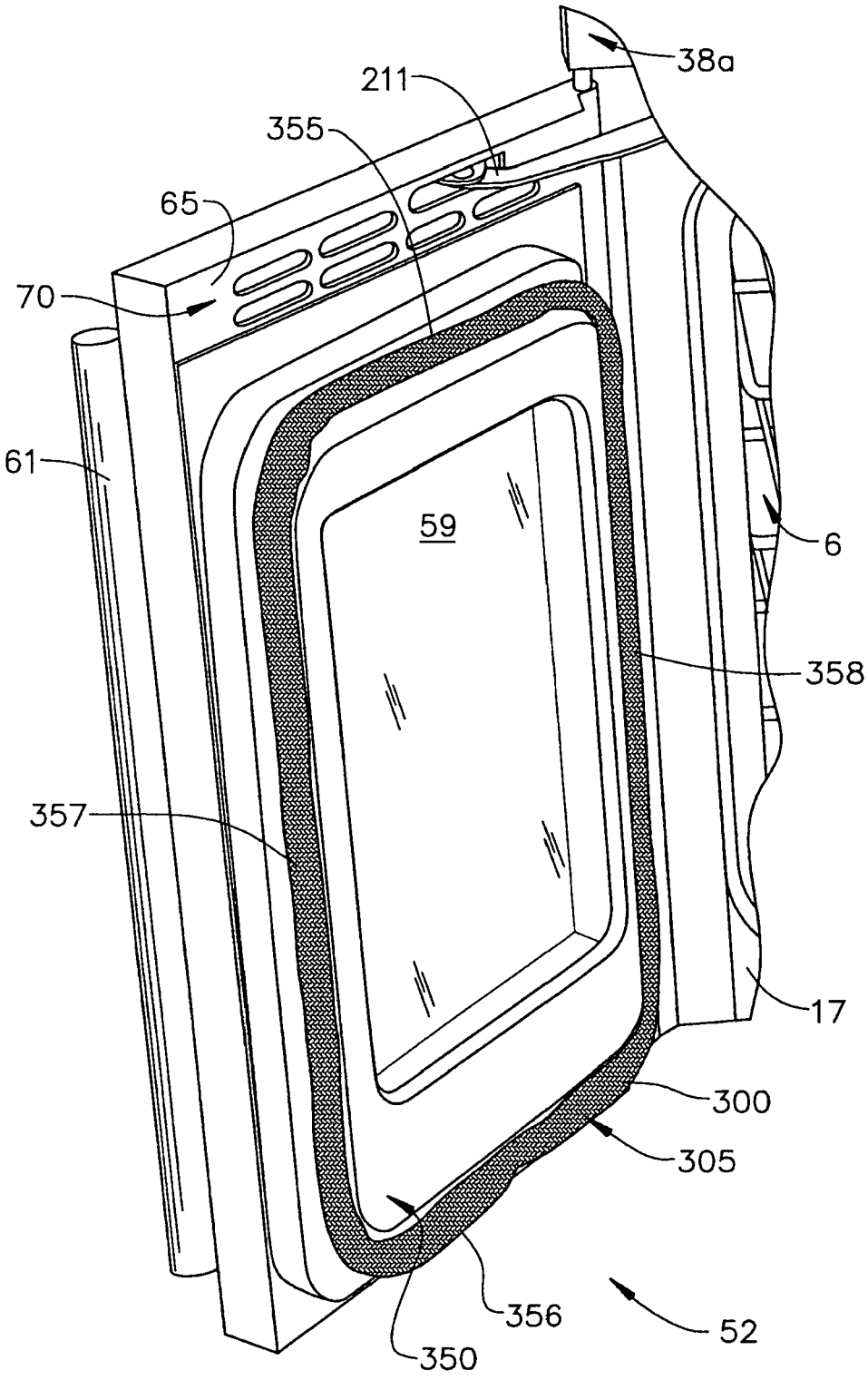
FIG. 13 is an enlarged perspective view of one of the doors of the cooking appliance of FIG. 12, particularly illustrating the construction of a first gasket.
Figure 14:
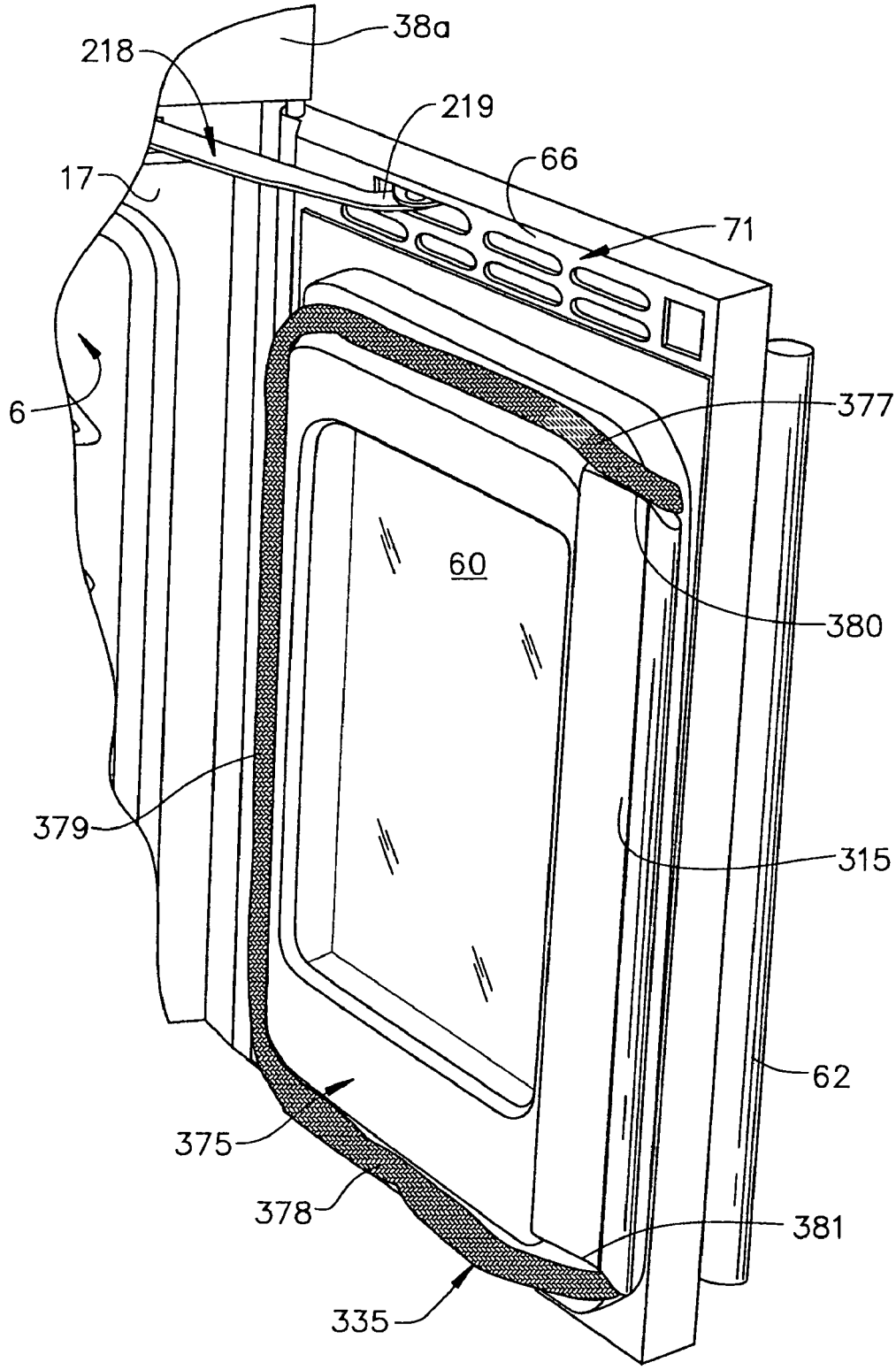
FIG. 14 is an enlarged perspective view of another one of the doors of the cooking appliance of FIG. 12, particularly illustrating the construction of a second gasket.
Figure 15:
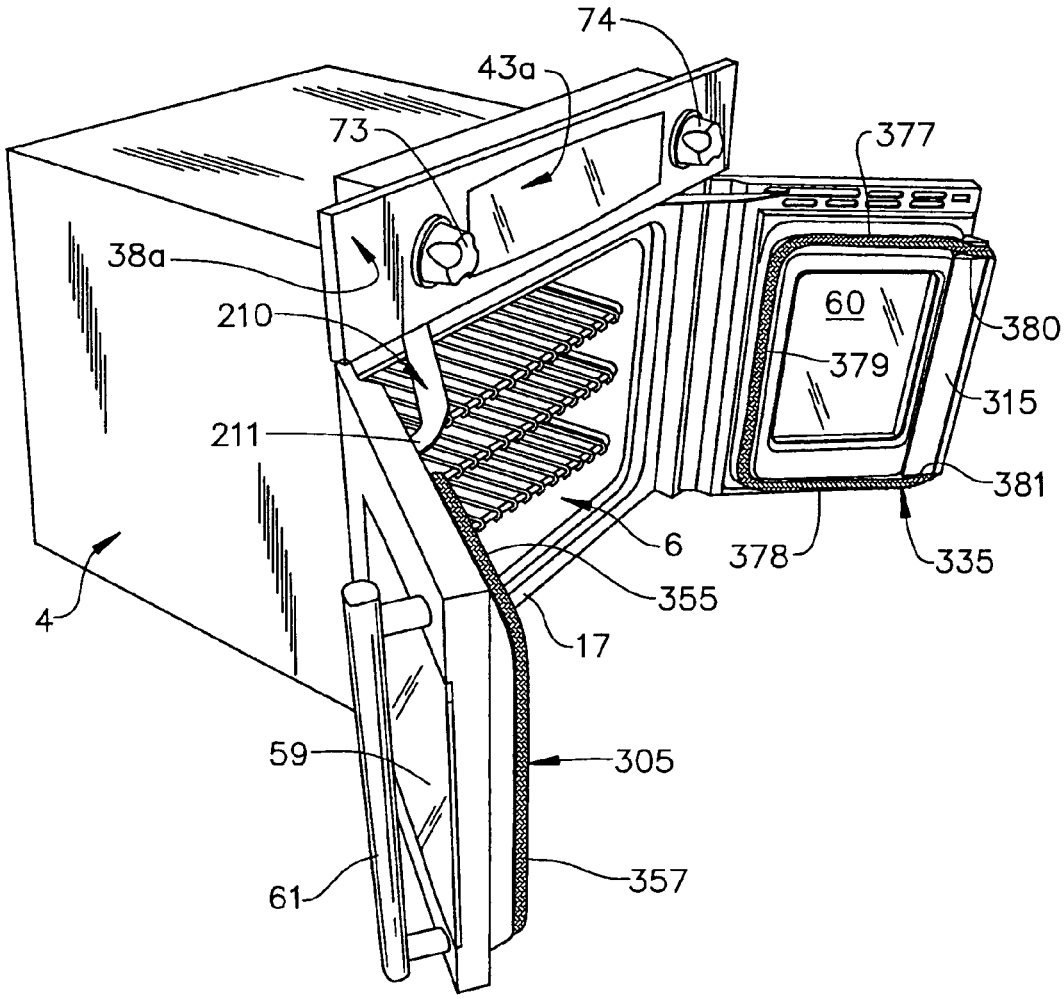
FIG. 15 shows the cooking appliance of FIG. 12 in another perspective view with the doors open.

This advantageous feature of the invention is best seen in connection with FIGS. 7-11 where like reference numbers represent corresponding parts to those disclosed above. In FIG. 7, doors 52 and 53 are fully closed, with an inner portion 300 of a first door seal or gasket 305 provided about door 52 engaging a portion of door 53. The embodiment depicted illustrates door 53 being provided with a lateral extension member 315 against which gasket 305 seats. However, it should be understood that door 53 could itself be formed for sealing engagement by gasket 305. The preferred configuration of gasket 305, as well as a gasket 335 provided on door 53, will be detailed more fully below with reference to FIGS. 12-15 where like reference numbers represent similar parts as discussed above. At this point, it is important to note that, as doors 52 and 53 are opened, only a very limited relative movement is required to unseat inner portion 300 of gasket 305. Actually, as shown in FIG. 8, only a few degrees of door movement, preferably 3-5° of movement, is required for this disengagement to occur. As the contact has been broken at this initial stage, no potential for any wear or abrasion of gasket 305 will occur throughout the remainder of the door opening process. In any case, FIGS. 9-11 show further opening stages as well wherein, advantageously, gasket 305 is not touched by any other surface through the door movement range. In fact, both gaskets 305 and 335 are cleared from further surface contact with a relatively minimum door opening range of movement as clearly illustrated in these figures. As previously stated, avoiding unnecessary contact with gaskets 305 and 335 minimizes potential wear and abrasion so as to significantly increase the life and effectiveness of each gasket 305, 335. However, it is the significant wear and abrasion that can occur between gasket 305 and door 53 that is particularly avoided.

As clearly shown in FIGS. 12-15, gasket 305 preferably extends annularly about an entire inner peripheral portion 350 of door 52. In the embodiment shown, gasket 305 includes opposing, substantially parallel gasket side portions 355, 356 and 357, 358, with side or center portion 357 actually being adapted to engage door 53. On the other hand, gasket 335 only extends about three-fourths of an inner peripheral portion 375 of door 53. That is, gasket 335 includes an upper and lower, substantially parallel gasket side portions 377 and 378 that are joined by a single gasket side portion 379. Therefore, upper and lower side portions 377 and 378 terminate at upper and lower portions 380 and 381 of extension member 315. With this arrangement, a tight seal can be established without seal-to-seal contact and only one seal member, i.e., gasket 305, having to engage the opposing door, i.e., door 53.

Based on this construction, the particular structure and arrangement of gaskets 305 and 335 themselves provide for enhanced seal life. In particular, door linkage system 200 of the present invention overcomes an issue of slop in the mechanism by intentionally moving one of doors 52 and 53 farther than the other of doors 52 and 53 when doors are first opened. For example, instead of doors 52 and 53 opening evenly, door 52 initially moves significantly farther than door 53, breaking contact between gasket 305 and a mating portion or extension member 315 of door 53. In the most preferred form of the invention, the oven cavity 6/cabinet shell 4, as well as extension member 315, is provided with a porcelain coating. With this construction, each of gaskets 305, 335 is only seated against porcelain coated surfaces to minimize wear caused by surface roughness.

As discussed above, annular gasket 305, or more particularly gasket side member 357, does not make contact with the side (not separately labeled) of door 53. Instead, the gasket side member 357 of gasket 305 contacts extension member 315 of door 53. Extension member 315 places the contact surface mostly behind gasket 305. As doors 52 and 53 are opened, the timing established by linkage system 200 pulls gasket 305 away from extension member 315. By breaking the contact early in the door opening process, gasket 305 is saved from any unnecessary crushing or abrasion.

An additional feature of the invention is that different rates of movement are imparted to doors 52 and 53 when nearing closed positions in order to help assure good contact of the center seal. That is, the timing established by linkage system 200 continues to pull doors 52 and 53 closed until gasket side portion 357 makes contact with extension member 315, thereby providing a mechanically advantaged force to balance a force applied by a door closure spring (not separately labeled). In any case, although described with reference to preferred embodiments of the present invention, it should be readily apparent to one of ordinary skill in the art that various changes and/or modifications can be made to the invention without departing from the spirit thereof.

We claim:

1. A cooking appliance comprising:

a frame;

an oven cavity supported, at least in part, by the frame, said oven cavity including top, bottom, rear and opposing side walls that define a frontal opening;

a first door pivotally mounted relative to the frame for selectively closing, in part, the frontal opening, said first door including an inner panel portion and an outer panel portion;

a second door pivotally mounted relative to the frame for selectively closing, in part, the frontal opening, said second door including an inner panel portion and an outer panel portion;

a first gasket positioned on the inner panel portion of the first door, said first gasket being substantially annular, with the first gasket including opposing gasket side portions that extend about an entire periphery of the inner panel portion of the first door; and a second gasket positioned on the inner panel portion of the second door, said second gasket being substantially less than annular, with the second gasket including a plurality of gasket portions that extends only about a partial portion of a periphery of the inner panel portion of the second door.

2. The cooking appliance according to claim 1, wherein the second gasket extends about three-fourths of the periphery of the inner panel portion of the second door.

3. The cooking appliance according to claim 1, wherein the second door includes a lateral extension member, one of said opposing gasket side portions of the first gasket member being adapted to abut the lateral extension member when the first and second doors are in a closed position to completely seal about the frontal opening.

4. The cooking appliance according to claim 3, further comprising: a linkage mechanism operatively coupled to each of the first and second doors, said linkage mechanism timing movement of the first and second doors so as to unseat the one of the opposing gasket portions from the lateral extension member upon a slight opening movement of either of the first and second doors.

5. The cooking appliance according to claim 4, wherein the slight opening movement is constituted by one of the first and second doors pivoting outward approximately 3-5 degrees.

6. The cooking appliance according to claim 4, wherein the timing mechanism shifts the second door toward a closed position at a rate faster that the first door to ensure that the one of the opposing gasket portions seats upon the lateral extension member.

7. The cooking appliance according to claim 1, wherein the second gasket extends about three sides of the periphery of the inner panel portion of the second door.

8. The cooking appliance according to claim 1, wherein the second gasket has first and second ends which terminate at positions spaced from each other such that a gasket gap is established about the periphery of the inner panel portion of the second door.

9. The cooking appliance according to claim 1, wherein the second gasket has an overall length which is substantially less than an overall length of the first gasket.

10. A method of operating a closure system for a cooking appliance having French-Style doors and an oven cavity including top, bottom, rear and opposing side walls that define a frontal opening comprising:

opening the closure system by:

shifting one of first and second doors that extend across the frontal opening of the oven cavity from a closed position towards an open position;

unseating a first gasket mounted to an inner panel of the first door from an outer peripheral edge of the frontal opening, said first gasket being substantially annular including opposing gasket portions that extend about an entire periphery of the inner panel of the first door;

unseating a second gasket mounted to an inner panel of the second door from the outer peripheral edge of the frontal opening, said second gasket being substantially less than annular including a plurality of gasket portions that extends only about a partial portion of a periphery of the inner panel of the second door; and exposing the oven cavity.

11. The method of claim 10, wherein the second gasket extends about three-fourths of the periphery of the inner panel of the second door.

12. The method of claim 10, further comprising: unseating one of the opposing gasket portions of the first gasket from a lateral extension member provided on the second door as either of the first or second doors is opened.

13. The method of claim 12, wherein the one of the opposing gasket portions unseats from the lateral extension member upon a 3-5 degree movement of one of the first and second doors.

14. The method of claim 10, further comprising: establishing an opening timing for the first and second doors wherein the first door is opened faster than the second door upon movement of either of the first and second doors.

15. The method of claim 10, further comprising:

closing the closure system by:

shifting one of first and second doors that extend across the frontal opening of an oven cavity from the open position towards the closed position;

seating the second gasket against the outer peripheral edge of the frontal opening; and seating the first gasket against the outer peripheral edge of the frontal opening.

16. The method of claim 15, further comprising: seating one of the opposing gasket portions of the first gasket upon a lateral extension member provided on the second door.

17. The method of claim 16, further comprising: establishing a closing timing for the first and second doors, said closing timing ensuring that the second door closes faster than the first door, causing the one of the opposing gasket portions of the first gasket to seal against the lateral extension member.

18. The method of claim 10, wherein the second gasket extends about three sides of the periphery of the inner panel portion of the second door.

19. The method of claim 10, wherein the second gasket has first and second ends which terminate at positions spaced from each other such that a gasket gap is established about the periphery of the inner panel portion of the second door.

20. The method of claim 10, wherein the second gasket has an overall length which is substantially less than an overall length of the first gasket.

* * * * *